United States Patent [19]

Baraff et al.

[11] 4,232,212

[45] Nov. 4, 1980

[54] THERMAL PRINTERS

[75] Inventors: David R. Baraff, Ottawa; Lawrence H. Hobbs, West Carleton, both of Canada

[73] Assignee: Northern Telecom Limited, Montreal, Canada

[21] Appl. No.: 948,240

[22] Filed: Oct. 3, 1978

[51] Int. Cl.[3] ..... H05B 1/00

[52] U.S. Cl. ..... 219/216; 219/543

[58] Field of Search ..... 219/216, 543; 346/76 R, 346/76 PH

[56] References Cited

U.S. PATENT DOCUMENTS

| | | | |
|---|---|---|---|
| 3,984,844 | 10/1976 | Tanno et al. | 219/216 X |
| 4,074,109 | 2/1978 | Baraff et al. | 219/543 X |
| 4,099,046 | 7/1978 | Baynton et al. | 219/216 |
| 4,149,171 | 4/1979 | Sato et al. | 346/76 PH X |

*Primary Examiner*—C. L. Albritton

*Attorney, Agent, or Firm*—Sidney T. Jelly

[57] ABSTRACT

Any element of a thermal print bar of resistive material is heated by a current pulse passed across the bar between an appropriate conductor pairing. Certain conductors are deposited in two parts with a rectifying layer deposited between the parts to provide diode isolation of heating paths from one another.

12 Claims, 2 Drawing Figures

THERMAL PRINTERS

Figure 1:
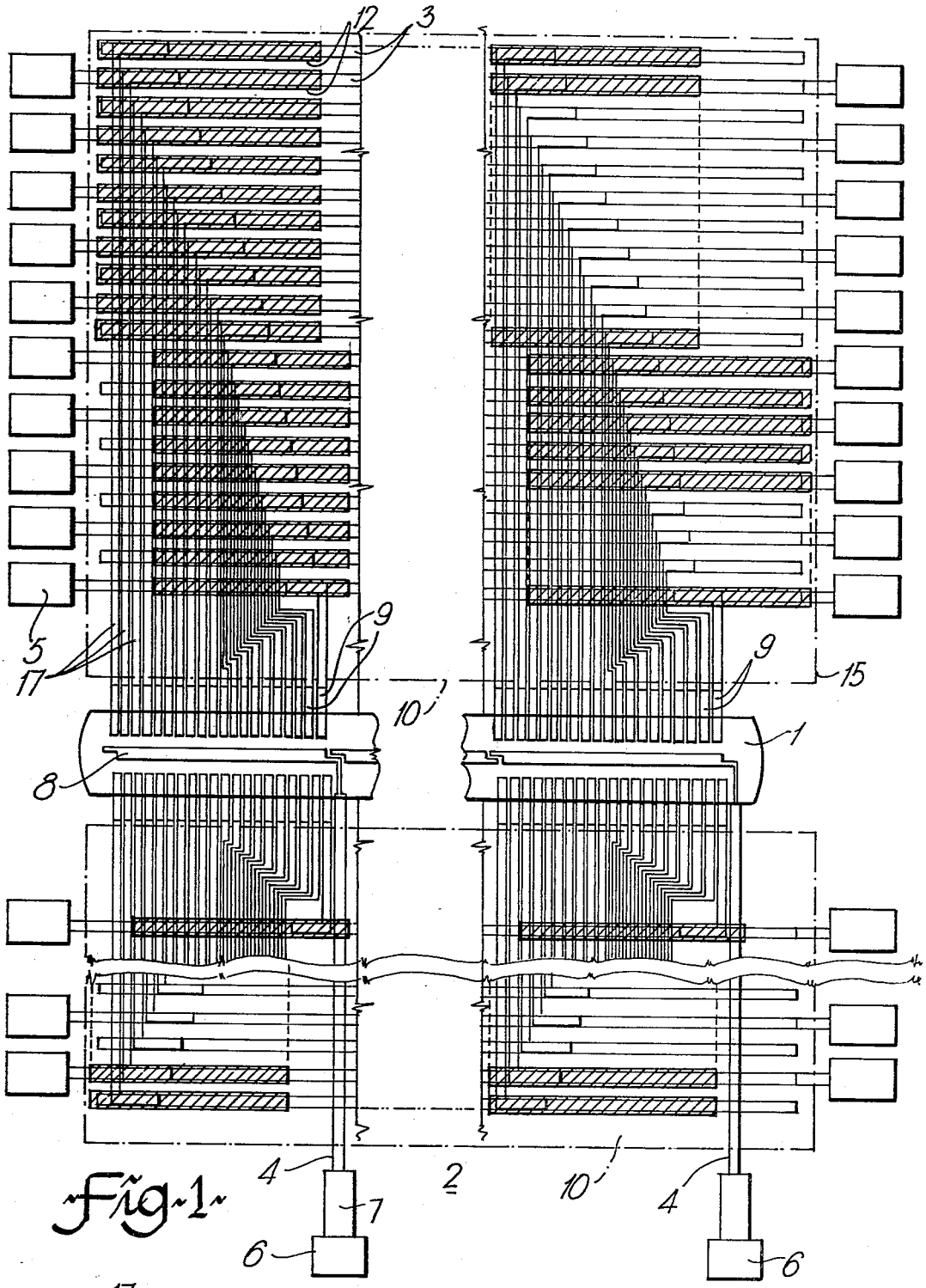

This invention relates to a thermal printing device particularly but not exclusively for, facsimile printing. The invention extends to a method of fabricating the thermal printing device.

Thermal printing devices are known having a print bar in the form either of a number of individual, discrete heating elements or, as described in our copending application Ser. No. 815,794 filed July 15, 1977 in the form of a continuous strip of resistive material. Each of the elements or specific areas of the strip, as the case may be, can be heated using a pattern or addressing conductors to allow passage of a current pulse, the pulse producing a "hot spot" at the selected element or area.

Electrical isolation of heating current paths from one another is desirable since activation of an unselected element on the same addressing conductor as a selected element can cause ghosting of the resulting heat image on a thermally sensitive receptor sheet in contact with the print bar. Two methods of incorporating diode isolation in print bars are known. In the first, silicon diodes are mounted on a substrate and connected to the thermal print bar using wire bond or beam lead technology. To achieve a resolution of 200 lines per inch a relatively massive printer which can directly print on an 8½" wide page, requires 1700 diodes. The number of wire bonds required is prohibitively expensive and the probability of poor bonds mean rework is likely to be necessary thereby adding repair costs to initial processing costs. Another approach employs a silicon or silicon-on-sapphire structure with diffused diodes. Monolithic diodes have hitherto been used only in small low resolution applications. Maximum wafer sizes available are of the order of 4 inches. Accordingly an 8½" bar would need to be made up of a number of wafers.

According to one aspect of the invention a thermal printing device comprises an electrically insulating substrate supporting a film of resistive material and first and second conductor patterns so as to establish resistive heating paths between closely spaced parts of said first and second conductors, a rectifying layer interposed between other parts of said first conductors and respective conductors of a third conductor pattern to provide diode barriers therebetween, the second and third conductor patterns being tailored for application of addressing signals.

The rectifying layer preferably incorporates a chlorine doped selenium layer and a cadmium layer. The cadmium layer can also serve as an ohmic contact to said third conductor pattern. Said first and second conductor patterns can be formed of nickel. Preferably though, those parts of the first and second conductor patterns adjacent and contacting the resistive material together with the third conductor pattern are etched gold films.

According to another aspect of the invention a method of fabricating a thermal printing device comprises depositing onto an insulating substrate first and second patterns of addressing conductors and a pattern of linkage conductors, printing a strip of resistive material to establish resistive heating paths between the second addressing conductor and respective ones of the linkage conductors, depositing a rectifying layer over discrete areas of said first addressing conductors to form diodes, and depositing a third pattern of conductors to connect the diodes to respective ones of said linkage conductors.

The first conductor pattern can be a screen printed thick film pattern of nickel conductors. The second conductor pattern and the linkage conductors can be a screen printed thick film pattern of gold conductors.

Figure 2:
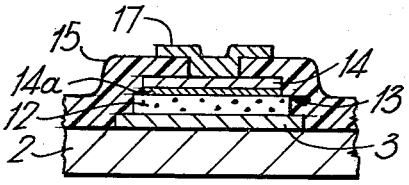

An embodiment of the invention will now be described by way of example with reference to the accompanying drawings, in which:

FIG. 1 is a diagrammatic perspective view of part of a thermal printing device to illustrate conductor patterns used to address specific elements or parts of a print bar; and FIG. 2 is a sectional view showing part of a thermal printing device illustrating the structural detail of the invention.

As illustrated in FIG. 1, a single, long, continuous strip 1 of electrically resistive material is screen printed onto an insulating substrate 2 of ceramic material to form a thermal print bar. In operation of the thermal printing device of which the print bar forms part, a thermally sensitive receptor sheet (not shown) is moved slowly past the bar, and, by passing current pulses through selected areas of the bar to produce joule heating, closely adjacent parts of the sheet are thermally activated and pels or darkened regions result. By pulsing the bar at preselected time and locations, an image can be built up on the receptor sheet corresponding to an incoming video signal. Alternatively, the print bar is not continuous but consists of discrete individually addressable elements. In another alternative, the receptor sheet is held static while the print bar is moved.

A variety of addressing techniques are known, but conductor patterns of FIG. 1 are specifically designed for a scan technique. By this technique, pulses are applied periodically to certain conductors in a matrix; these pulses, termed scan pulses, ideally have no effect unless, simultaneously a data pulse appears at one of the other conductors in the matrix whereupon a current path in the resistive strip between adjacent pulsed conductors is heated.

Referring particularly to FIG. 1, the matrix of addressing conductors is constituted by row conductors 3 to which the scan pulses are applied, and by column conductors 4 to which data pulses are applied, the pulses being applied at respective contact pads 5, 6 and being derived from pulse generation circuitry (not shown).

In fabricating the printing device, the scan conductors 3 and outer parts 7 of the data conductors 4 are first printed as parallel thick film nickel strips which are then air abraded and thoroughly cleaned by scrubbing, rinsing and reflux drying. Next, inner parts 8 of the column conductors 4 and linkage conductors 9 are printed as a gold film which is subsequently etched. The resistive strip 1 is then printed over parts 8 of the data conductors and over extremities on the linkage conductors 9, the strip 1 subsequently being baked. A typical material for the strip 1 is a resistor ink supplied under the trade name DuPont 1431 which has a resistivity of the order of 1 KΩ per square.

A layer 12 of selenium doped with halogen impurity, for example, chlorine with a concentration level of 60–600 ppm is then vacuum evaporated through the mask to a thickness of 50 microns. The selenium is then subjected to an annealing process in which it is heated to 200° C., this temperature being held for 90 minutes before cooling.

Following annealing, the selenium rectangles are coated with lacquer 13 and baked for 30 minutes. The purpose of the lacquer layer, which is a few molecules thick is to limit diffusion of a subsequent layer and to provide reverse breakdown characteristics of the finished diode.

Next, a mask carrying an array of rectangles each slightly smaller than the selenium rectangles is placed over the substrate so that the rectangle centres coincide. A layer 14 of cadmium is then vacuum evaporated at a pressure of $10^{-5}$ Torr onto the lacquered selenium. The cadmium which contacts the selenium reacts to form a layer 14*a* of cadmium selenide. The cadmium selenide-selenium interface forms a pn diode. Excess cadmium forms an ohmic contact with the cadmium selenide.

After the cadmium layer has been deposited, a layer 15 of dielectric material, such as epoxy, is screened over the diode array; an example of a suitable material is Englehard No. A-3313. A screen which leaves holes over respective diodes is used to provide contact vias. The epoxy is cured at a low temperature in order to preserve the crystallographic structure of the selenium. Typically the epoxy is heated to 100° C. for about 3 hours.

A film 16 of gold is next vacuum evaporated at a pressure of $10^{-5}$ Torr over the area of the diode array and the ends of the linkage conductors 9, the gold film 16 having a thickness of about 3000 Å. Using well know photolithographic and chemical etching techniques, conductors 17 are formed to connect the linkage conductors 9 to respective diode top contact.

Finally, the diodes are electrically formed to create the rectifying junction. This is accomplished by passing through the devices an alternating current such that a reverse bias leakage current of approximately 2 mA is maintained over a period of 30 minutes.

Operation of the printing device takes place on application of a voltage to an opposed pair of linkage conductors and by means of the addressing conductors 3 and 4. A hot spot within the print bar occurs at the adjacent ends of the selected linkage conductors. A receptor sheet of thermally sensitive composition is held in contact with the print bar and is marked by pels or darkened regions where it touches hot spots. The receptor sheet is moved past the print bar at a rate commensurate with the application of pulses to the data and scan electrodes 4 and 3 in order that a printage image can be generated from a video signal.

The presence of the diodes does not inhibit application of scan and data pulses to heat a chosen element in the thermal print bar but the diodes do act to block the generation of current loops which would otherwise raise non-selected conductors which are not grounded to a high voltage, thereby causing inadvertent heating of a part of the print bar.

What is claimed is:

1. A thermal printing device comprising an electrically insulating substrate supporting a film of resistive material and first and second conductor patterns electrically contacting said film of resistive material so as to establish resistive heating paths through said resistive material between closely spaced end parts of said first and second conductors, the conductors of the first pattern being matrix-addressed by a third pattern of conductors, the conductors of the third pattern electrically connected to respective sets of said first pattern of conductors at contact regions formed as rectifying junctions remote from the resistive material, the second and third conductor patterns being tailored for application of addressing signals.

2. A thermal printing device as claimed in claim 1, in which said rectifying junctions are formed at the interface of a halogen doped selenium layer and a cadmium layer.

3. A thermal printing device as claimed in claim 2, in which said halogen is chlorine with a dopant level of 60–600 ppm.

4. A thermal printing device as claimed in claim 1, in which said conductor patterns are deposited using a thick film technique and said rectifying junctions are deposited using a thin film technique.

5. A thermal printing device as claimed in claim 1 in which said resistive material is a bar extending in a first direction, said end parts of said conductors are elongate and extend underneath and parallel to the bar generally centrally thereof, and the end parts of the second conductors contact the bar at opposed edges thereof.

6. A thermal printing device as claimed in claim 5 in which said first and second conductors extend from the bar in a second direction generally perpendicular to the first direction and the third conductors extend in the first direction, the second conductors having contact pads along an edge of the structure extending in the first direction and the third conductors having contact pads along an edge of the substrate extending in the second direction.

7. A method of fabricating a thermal printing device comprises depositing onto an insulating substrate first and second patterns of addressing conductors and a pattern of linkage conductors, printing a strip of resistive material to establish resistive heating paths between the second addressing conductors and respective ones of the linkage conductors, depositing a rectifying layer over discrete areas of said first addressing conductors to form diodes, and depositing a third pattern of conductors to connect the diodes to respective ones of said linkage conductors.

8. A method as claimed in claim 7, in which said first pattern of conductors is thick film screen printed as a series of nickel rows.

9. A method as claimed in claim 8, in which said second conductor pattern is deposited at least partially as a thick film of gold which is etched to define separate conductors.

10. A method as claimed in claim 9, in which said strip of resistive material is deposited over lengths of said second conductors which are parallel with said first conductors.

11. A method as claimed in claim 8, in which said rectifying layer is formed by vacuum deposition of a halogen doped selenium layer followed by vacuum deposition of a cadmium layer.

12. A method as claimed in claim 11, in which said rectifying layer is preceded by deposition of an ohmic contact layer consisting of nickel plate, vacuum evaporated gold, and vacuum evaporated nickel chrome alloy.

* * * * *